United States Patent [19]

Goff, Jr. et al.

[11] 3,965,943

[45] June 29, 1976

[54] NARROW ELASTIC FABRIC FOR USE AS WAISTBAND IN ARTICLES OF APPAREL

[75] Inventors: Richard E. Goff, Jr., Barrington; Normand D. Guay, Woonsocket, both of R.I.

[73] Assignee: Johnson & Johnson, New Brunswick, N.J.

[22] Filed: Nov. 11, 1974

[21] Appl. No.: 522,570

[52] U.S. Cl. ..... 139/421; 2/237

[51] Int. Cl.[2] ..... D03D 15/08; A41D 1/06

[58] Field of Search ..... 139/421–423; 2/237, 236, 221; 161/77; 428/231

[56] References Cited

UNITED STATES PATENTS

| | | | |
|---|---|---|---|
| 3,172,430 | 3/1965 | Weidhaas | 139/422 |
| 3,788,365 | 1/1974 | Campbell, Sr. et al. | 139/421 |
| 3,788,366 | 1/1974 | Campbell, Sr. et al. | 139/421 |
| 3,858,622 | 1/1975 | Campbell et al. | 139/421 |
| 3,860,046 | 1/1975 | Goff, Jr. et al. | 139/421 |

FOREIGN PATENTS OR APPLICATIONS

| | | | |
|---|---|---|---|
| 282,074 | 5/1966 | Australia | 139/421 |
| 1,426,301 | 12/1965 | France | 139/421 |
| 1,423,893 | 11/1965 | France | 139/422 |
| 1,075,646 | 4/1954 | France | 139/421 |

*Primary Examiner*—James Kee Chi

[57] ABSTRACT

A narrow elastic fabric for use as a waistband in an article of apparel comprising a set of warp yarns running in the direction of the length of the fabric woven with a set of monofilament filling yarns running in the direction of the width of the fabric. The warp set contains elastic yarns and continuous filament synthetic fiber texturized face yarns. The elastic yarns have a spandex core initially wrapped with a settable yarn. At least a portion of the continuous filament texturized face yarns are woven in a rib weave.

5 Claims, 3 Drawing Figures

NARROW ELASTIC FABRIC FOR USE AS WAISTBAND IN ARTICLES OF APPAREL

This invention relates to narrow elastic fabrics and more particularly to narrow elastic fabrics suitable for use as the waistband for articles of wearing apparel.

BACKGROUND OF THE INVENTION

Though the narrow elastic fabric of the present invention may be used, either by itself or in combination with other fabrics, in the body encircling portions of articles of apparel it will be herein described in its preferred specific use as the waistband for stretch trousers.

Trouser waistbands generally are made from a plurality of layers of fabric. These layers comprise; a lining to provide stiffness and body in the waistband which is covered with a "curtain fabric" for appearance and to finish the waistband. The curtain fabric and lining fabric are sewn to the outer fabric to provide the waistband. In some instances yet another fabric may be incorporated in the waistband in order to prevent unsightly rollover of the waistband. This is generally a stiffer fabric and may have a curvalinear or concave cross-section so as to aid in reducing the rollover problem. Fabrics and waistbands of this type are described in U.S. Pat. Nos. 3,129,434 and 3,155,986.

With the advent of the use of stretch materials such as double knit fabrics in trousers some stretch materials have been developed for use in waistbands to provide the desired stiffness and stretch. One such material comprises monofilament yarns running in the direction of the width of the fabric woven with textured synthetic yarns running in the direction of the length of the fabric. The woven fabric is coated with a latex composition. The monofilaments provide stiffness in the widthwise direction and the textured yarns and latex stretch in the lengthwise direction.

Another type of waistband which has been used in trousers is described in U.S. Pat. No. 2,757,381. This waistband is an elastic fabric having a portion with less stretch than the remainder of the fabric and with a sewing portion between the stretch portions. The portion having less stretch is meant to extend above the outer trouser fabric and form the trouser waist while the portion having more stretch is inside the trousers to form the waistband.

The prior art waistbands generally suffer from one or more of the following deficiencies; poor washability, poor dry cleanability, lack of shrinkage control, lake of stiffness, lack of body, failure to prevent rollover of the trousers, insufficient elongation for use with stretch trousers, complicated manufacturing techniques of the material itself or of the waistband, excessive costs, poor recoverability and/or resilience and so forth.

Recently some new elastic fabrics have been developed for use as waistbands. One such fabric is described in U.S. Pat. No. 3,788,366, wherein monofilament filling yarns are woven with elastic warp yarns using a leno weave. In U.S. Pat. No. 3,788,365 another fabric is disclosed wherein filling yarns are woven with elastic warp yarns in a pronounced rib weave. Though both of these fabrics overcome many of the deficiencies of previous waistbands as described above they are costly, in some instances require a special weave, i.e. leno weave, or cause manufacturing difficulties by requiring the elastic warp yarns to float over the filling yarns to produce a pronounced rib.

SUMMARY OF THE INVENTION

We have discovered an improved waistband fabric which overcomes the above mentioned problems. Our improved waistband has good washability and dry cleanability with low shrinkage.

Our improved waistband is stiff in the widthwise direction and has excellent resiliency or spring-back.

Our improved waistband has abrasion resistant frictional gripping areas distributed over the surface of the waistband to aid in holding shirt and blouses in trousers, skirts and the like.

Our improved waistband, though preferably used alone, may be used in combination with other fabrics to form a trouser waistband. Our improved waistband is especially suitable for use in trousers made from stretch materials such as double knit fabrics. When our fabric is used various decorative patterns may be incorporated in the waistband to provide aesthetic affects in the final garment.

In accordance with the present invention our improved waistband is a narrow elastic fabric comprising a set of warp yarns running in the direction of the length of the fabric woven with a set of monofilament filling yarns running in the direction of the width of the fabric. The set of warp yarns contains elastic yarns and continuous filament synthetic fiber texturized yarns. The elastic yarns are wrapped yarns having a spandex core initially wrapped with a settable yarn. The settable yarns may be spun yarns, multifilament yarns, or monofilament yarns. Settable yarns are yarns which when shrunk, heated or otherwise treated as is well-known, have greatly reduced shrinkage characteristics and tend to maintain a given configuration with little change under washing or dry cleaning procedures. Examples of such settable yarns are those made from nylon or polyester. The settable yarn may then be covered with other types of yarns such as cotton, rayon or synthetic yarns to give the final elastic yarn the desired hand as well as the desired cover and appearance in the final fabric. The elastic warp yarns are woven with the monofilament filling yarns in a one over one plain weave to provide uniform elongation, power, coverage and the like.

The warp set also contains continuous filament synthetic fiber texturized yarns such as texturized nylon yarns, texturized polyester yarns and the like. The continuous filament synthetic fiber texturized warp yarns are woven with the monofilament filling yarns in a rib weave with the texturized warp yarns passing over at least three adjacent filling yarns so as to produce a minimum of five ribs per inch and a maximum of eight ribs per inch on each side of the fabric with the ribs running in the transverse direction of the fabric. These rib woven texturized yarns are herein referred to as face yarns because they form the outermost surfaces or faces of the fabric.

The above described combination of yarns, weave and number of ribs produces a fabric having transverse stiffness and resiliency coupled with uniform elongation, power and recovery properties and good washing and dry cleaning characteristics. Our new fabric also has a plurality of abrasion resistant frictional gripping areas uniformly distributed on both surfaces of the fabric which make our new fabric especially suitable for use as a waistband as these areas aid in holding down shirts and blouses and the like.

Our new fabric has from about 5% to 50% elongation in the direction of its length and a uniform modulus of elasticity across its width. The modulus of elasticity will be from about one to five pounds per inch of the width of the fabric at 15% elongation. The fabric has less than 3% shrinkage and is washable and dry cleanable and may be used alone or in combination with other fabrics such as linings, etc. as the waistband for an article of apparel.

BRIEF DESCRIPTION OF THE DRAWINGS

The invention will be more fully described when taken in conjunction with the accompanying drawings wherein.

DETAILED DESCRIPTION OF THE DRAWINGS

Figure 1:
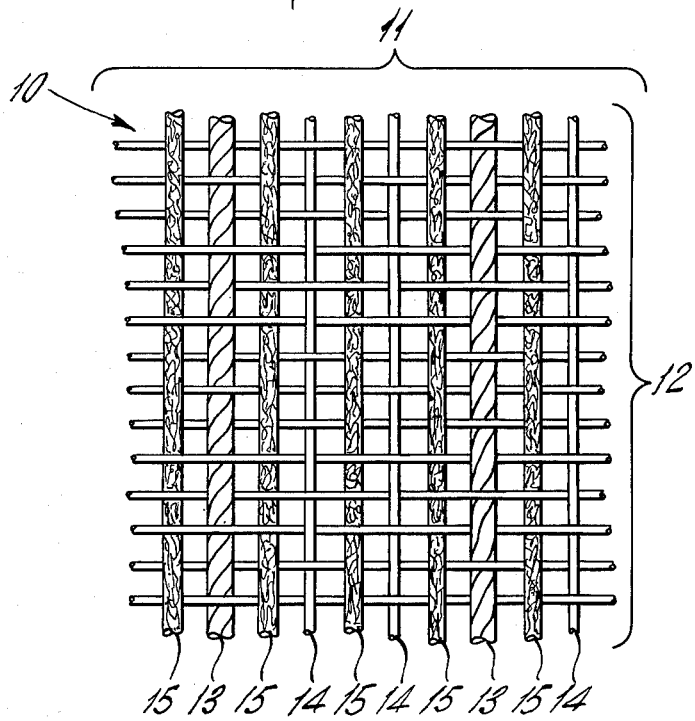
FIG. 1 is an enlarged plan view of a portion of a narrow elastic waistband fabric of the present invention.

Referring to the drawings there is shown in FIG. 1 an enlarged plan view of a portion of the improved waistband fabric 10 of the present invention. It should be noted that the view shows only a portion of the fabric both across the width of the fabric and along its length. The fabric comprises a set of warp yarns 11 interwoven with a set of filling yarns 12. The set of warp yarns contains elastic yarns 13 as previously described. The warp set also contains binder yarns 14 as are commonly used in weaving narrow elastic fabrics and continuous filament synthetic fiber texturized yarns 15.

The elastic yarns and the binder yarns are woven one up and one down in a plain weave throughout the fabric. This uniform plain weave provides uniform elongation, power, shrinkage and similar properties throughout the fabric.

The continuous filament synthetic fiber texturized yarns are woven three up and three down throughout the fabric. This weave improves the transverse stiffness and resiliency of the fabric and provides abrasion resistant frictional gripping surfaces over the surface of the fabric.

As previously described the core of the elastic yarn is spandex and the initial wrap of this core is with a settable yarn such as a polyester or nylon yarn. It is important that a spandex core and not a rubber core be used in producing the waistband fabric of the present invention as the setting or initial wrapping yarn will tend to cut the rubber core and produce free ends of rubber which are abrasive and unsightly.

Spandex cores having a denier of from about 800 to 2240 initially wrapped with a settable yarn having a denier of from about 75 to 200 or more, and covered with a synthetic yarn produce satisfactory elastic yarns for use in producing the waistbands of the present invention.

The binder yarns may be any of the well-known spun, multifilament or monofilament yarns. If desired the binder yarns may be continuous filament and texturized yarns similar to the face yarns used in making the fabric in accordance with the present invention. The criteria for determining the type of binder yarns used are cost, cover, hand, decorative effects desired in the final product and the like.

The continuous filament synthetic fiber texturized yarns; i.e., the face yarns, may be any of the well-known stretch or texturized yarns, such as nylon, polyester, or similar yarns. The continuous filament texturized face yarns should have a denier of from 100 to 400.

The filling yarns used are monofilament yarns to produce the desired stiffness, resilience, and recovery in the widthwise direction of the fabric. Generally it is preferred that about 850 to 1100 denier monofilament yarns be used as the filling yarns.

The elastic warp yarns and the binder warp yarns may be woven with various types of uniform plain weaves and the weave may be varied across the width of the fabric to provide decorative effects in the final fabric.

The continuous filament synthetic fiber texturized face yarns must be floated over at least three adjacent filling yarns to obtain the desired combination of results as previously described. The face yarns may be floated over more filling yarns if desired, however the weave must be such as to form a minimum of five transverse ribs on each surface of the fabric and a maximum of eight such ribs on each surface. Fewer ribs on each surface produces rough uneven surfaces and is detrimental to the resilient properties of the fabric while too many ribs will not provide desired frictional gripping areas that are abrasion resistant. In certain embodiments of fabrics according to the present invention the transverse ribs need not extend across the full width of the fabric, however, it is preferred that the transverse ribs extend across a major portion of the width of the fabric.

Generally in weaving the fabric from about 75 to 150 warp yarns per inch are used with sufficient filling yarns per inch to produce the desired amount of elongation in the fabric and produce a fabric having from about 30 to 60 finished picks per inch.

When our new elastic fabric is to be used as the waistband of trousers, it should be woven in such a manner that a minimal number of warp yarns are used so as not to overpower the desired characteristics of the monofilament filling yarns. However, the warp yarns should be tied in place so that they do not slip up and down along the monofilament filling yarns and still produce the desired degree of elongation and modulus of elasticity in the final fabric.

Figure 2:
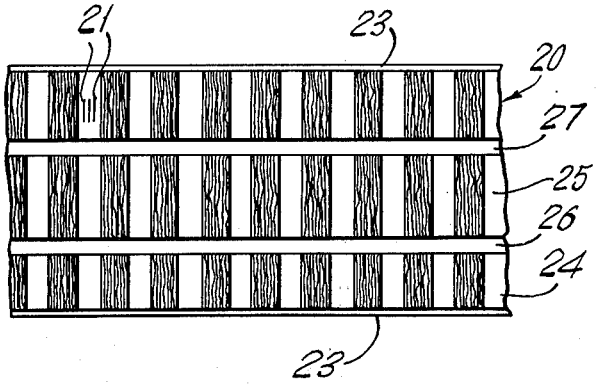
FIG. 2 is a plan view of an embodiment of the narrow elastic waistband fabric of the present invention.

A narrow elastic fabric 20 according to the present invention, suitable for use as the waistband in trousers, is shown in FIG. 2. The fabric contains synthetic, monofilament, filling yarns 21. When using monofilament filling yarns, at each end of the filling, where the yarn turns back on itself, because of the stiffness of the monofilament, a very sharp edge is formed. This sharp edge is uncomfortable to the wearer and creates wearing problems and rough edges in the final product.

Woven with the monofilament yarns along the edges of the fabric; that is, the two edge portions 22 and 23 of the fabric, are texturized yarns 24. Because of the very low stretch required in a trousers waistband, texturized yarns are used at these edges to cover the rough bent ends of the filling yarns and provide a smooth soft long-wearing edge both when the fabric is relaxed and when it is stretched. Generally from about 20 to 40 texturized yarns are woven along each edge portion of the fabric to provide a narrow soft band along each edge of the fabric.

The center portion 25 of the fabric is woven with elastic yarns, binder yarns and continuous filament stretch yarns as described in conjunction with FIG. 1. The two lines 26 and 27 in the center portion of the fabric are for decorative effect and are produced by omitting the warp yarns from this area.

Figure 3:
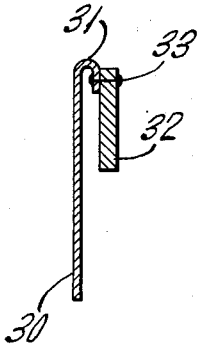
FIG. 3 is a cross-sectional view of the fabric of FIG. 2 as it would appear when sewn to the waist portion of a pair of trousers.

Referring to FIG. 3 there is shown a cross-sectional view of the fabric depicted in FIG. 2 as sewn to an outer apparel fabric to form a waistband. The outer fabric 30 is folded over along its upper edge 31 and the waistband 32 is directly sewn 33 to the folded edge to form the waistband of the garment. Other techniques may also be used for securing our improved waistband to the outer fabric. For example, the outer fabric may be folded a plurality of times, the waistband may be secured to the inside portion of the fold, and so forth. Furthermore, the bottom portion of the waistband may be tacked to the pants portions or other lining portions of the final trousers.

The stretch or elasticity in the final product and the modulus or power required to stretch the final product will depend upon a number of things. These are: (a) the amount or number of elastic yarns used in the warpwise direction and their distribution, (b) the degree of stretch in these elastic yarns; that is, the tension they are wrapped under, (c) the type of weave used, and (d) the number of filling yarns per inch used in the fabric.

The following is an illustrative example of an elastic waistband fabric according to the present invention.

EXAMPLE

Warp yarns are set up to weave a narrow elastic fabric in accordance with the present invention. The final fabric is to have a width of about 2-¾ inches and approximately 364 warp yarns are used. Starting from one side of the fabric and moving across to the other side of the fabric the warp yarns are as follows:

a. 32 ends of 100 denier, 2 ply, texturized nylon yarns woven in a tubular twill weave to provide a soft edge;

b. one end of an elastic yarn having a spandex core of 1680 denier initially wrapped with a 100 denier multifilament nylon yarn (set in its wrapped configuration) and top wrapped with 100 denier, 2 ply texturized nylon yarns;

c. one end of 70s/2 ply texturized nylon yarn as a binder yarn;

d. one end of 100s/2 ply texturized nylon yarn as a face yarn;

e. the binder and face yarns are repeated two more times to form the edge portion of the fabric.

The body of the fabric is woven with an elastic yarn as previously described followed by a face yarn, binder yarn, face yarn, binder yarn and face yarn as described.

This sequence of six yarns is repeated across the fabric to the opposite edge portion.

The opposite edge portion is woven with an elastic yarn as previously described followed by two binder yarns as described and 34 ends of 100 denier, 2 ply, texturized nylon yarns. The texturized nylon yarns on this edge are also woven in a tubular twill weave to provide a soft edge.

The elastic yarns and the binder yarns are woven in a standard plain one by one weave. The face yarns are woven in a 3 by 3 rib weave. The filling yarns used are 1100 denier nylon monofilaments and they are woven with about 29 picks to the inch during the weaving operation so that the finished fabric has about 40 filling yarns per inch.

The resultant fabric has less than 3% shrinkage and excellent washing and dry cleaning characteristics. The fabric by itself, when sewn to the upper portion of a pair of trousers, makes an excellent waistband for a trouser made from stretch material.

The above detailed description has been given for clearness of understanding only. No unnecessary limitations should be understood therefrom as modifications will be obvious to those skilled in the art.

What is claimed is:

1. A narrow elastic fabric suitable for use as a waistband for an article of apparel comprising; a set of warp yarns running in the direction of the length of the fabric woven with a set of monofilament filling yarns running in the direction of the width of the fabric, the set of warp yarns contains elastic yarns and continuous filament synthetic fiber texturized yarns, said elastic yarns have a spandex core wrapped with a yarn that is set in its wrapped configuration, said elastic warp yarns being woven with the filling yarns in a plain one-over-one weave, at least a portion of said continuous filament texturized warp yarns are woven with said filling yarns in a rib weave wherein said continuous filament texturized warp yarns pass over at least three adjacent filling yarns to produce a rib running in the transverse direction of the fabric to provide the fabric with transverse stiffness and resiliency and abrasion resistant frictional gripping areas.

2. A narrow elastic fabric according to claim 1 having from 5 to 8 ribs per inch running in the transverse direction of the fabric.

3. A narrow elastic fabric according to claim 1 wherein the filling yarns are monofilament nylon yarns.

4. A narrow elastic fabric according to claim 1 wherein the continuous filament synthetic fiber texturized yarns are texturized nylon yarns.

5. A narrow elastic fabric according to claim 1 wherein the set of warp yarns includes nonelastic binder yarns.

* * * * *